US005691674A

United States Patent [19]

Yorita et al.

[11] Patent Number: 5,691,674

[45] Date of Patent: Nov. 25, 1997

[54] DIELECTRIC RESONATOR APPARATUS COMPRISING AT LEAST THREE QUARTER-WAVELENGTH DIELECTRIC COAXIAL RESONATORS AND HAVING CAPACITANCE COUPLING ELECTRODES

[75] Inventors: Tadahiro Yorita; Hirofumi Miyamoto, both of Kanazawa, Japan

[73] Assignee: Murata Manufacturing Co., Ltd., Japan

[21] Appl. No.: 308,974

[22] Filed: Sep. 20, 1994

[30] Foreign Application Priority Data

Sep. 20, 1993 [JP] Japan ..... 5-233795

[51] Int. Cl.[6] ..... H01P 1/202

[52] U.S. Cl. ..... 333/202; 333/206

[58] Field of Search ..... 333/202, 206, 333/207

[56] References Cited

U.S. PATENT DOCUMENTS

| | | | |
|---|---|---|---|
| 4,523,162 | 6/1985 | Johnson | 333/202 |
| 5,130,683 | 7/1992 | Agahi-Kesheh et al. | 333/203 |
| 5,162,760 | 11/1992 | Phillips et al. | 333/206 |

FOREIGN PATENT DOCUMENTS

| | | | |
|---|---|---|---|
| 595623 | 5/1994 | European Pat. Off. | 333/206 |
| 241202 | 9/1990 | Japan | 333/202 DB |
| 5145302 | 6/1993 | Japan | 333/206 |
| 5183309 | 7/1993 | Japan . | |
| 5199011 | 8/1993 | Japan . | |
| 5299903 | 11/1993 | Japan | 333/202 |
| 6132706 | 5/1994 | Japan | 333/202 DB |
| 6164206 | 6/1994 | Japan | 333/202 DB |

*Primary Examiner*—Benny Lee

*Attorney, Agent, or Firm*—Ostrolenk, Faber, Gerb & Soffen, LLP

[57] ABSTRACT

A dielectric resonator apparatus comprising at least three quarter-wavelength dielectric coaxial resonators in a dielectric block is provided. In the dielectric resonator apparatus, an outer conductor is formed on the surfaces of the dielectric block, and a pair of input and output electrodes for capacitively coupling with the two dielectric coaxial resonators located at both ends is formed close to a first end surface of the dielectric block on a predetermined side surface of the dielectric block so as to be electrically insulated from the outer conductor. Further, two capacitance coupling electrodes for capacitively coupling with the two dielectric coaxial resonators, respectively, which are selected among at least three dielectric coaxial resonators and are located apart from each other so as to put another one dielectric coaxial resonator therebetween, are formed on the predetermined side surface of the dielectric block so as to be electrically insulated from the outer conductor and so as to be apart from the first end surface by a predetermined length. The two capacitance coupling electrodes are electrically connected through a bypass electrode.

19 Claims, 10 Drawing Sheets

DIELECTRIC RESONATOR APPARATUS COMPRISING AT LEAST THREE QUARTER-WAVELENGTH DIELECTRIC COAXIAL RESONATORS AND HAVING CAPACITANCE COUPLING ELECTRODES

BACKGROUND OF THE INVENTION

1. Field of the Invention

The present invention relates to a dielectric resonator apparatus, and in particular, to a dielectric resonator apparatus preferably for use as a dielectric filter, the dielectric resonator apparatus including at least three quarter-wavelength dielectric coaxial resonators and having capacitance coupling electrodes for obtaining internal coupling capacitances.

2. Description of the Related Art

Conventionally, there have been widely used as a band-pass filter, a band-elimination filter or the like, for example, in microwave band frequencies, a dielectric resonator apparatus constituted by forming a plurality of resonator electrodes in an inner portion of a dielectric block and forming an earth electrode and a pair of input and output electrodes on an outer surface of the dielectric block. In the specification, an electric conductor is referred to as a conductor hereinafter.

FIG. 5 is a perspective view of a conventional dielectric resonator apparatus 30 comprising a rectangular-parallelepiped-shaped dielectric block 40, and FIG. 6 is an exploded perspective view of the conventional dielectric resonator apparatus 30 shown in FIG. 5 prior to assembling the conventional dielectric resonator apparatus 30.

Referring to FIGS. 5 and 6, the conventional dielectric resonator apparatus 30 is composed of the dielectric block 40 and a device base 2 on which the dielectric block 40 is mounted. In the dielectric block 40, five circular cylindrical resonator holes 3*a*, 3*b*, 3*c*, 3*d* and 3*e* are formed so as to penetrate the dielectric block 40 between first and second end surfaces 1*a* and 1*b* of the dielectric block 40, respectively, and then inner conductors 4*a*, 4*b*, 4*c*, 4*d* and 4*e* are formed on inner peripheral surfaces of the respective resonator holes 3*a*, 3*b*, 3*c*, 3*d* and 3*e*, respectively. Further, an outer conductor 5 is formed on all the outer surfaces of the dielectric block 1. Each of the inner conductors 4*a* to 4*e* each having the longitudinal length of a quarter of the guide-wavelength λg/4, which are formed in the resonator holes 3*a*, 3*b*, 3*c*, 3*d* and 3*e*, has:

(a) an open-circuit end formed by cutting one end of each of the inner conductors 4*a*, 4*b*, 4*c*, 4*d* and 4*e* located on the side of the first end surface 1*a* of the dielectric block 1 so that each of the inner conductors 4*a*, 4*b*, 4*c*, 4*d* and 4*e* is electrically insulated from the outer conductor 5; and (b) another short-circuit end electrically connected to the outer conductor 5 located on the side of the second end surface 1*b* of the dielectric block 1.

Then the five inner conductors 4*a*, 4*b*, 4*c*, 4*d* and 4*e* respectively formed in the resonator holes 3*a*, 3*b*, 3*c*, 3*d* and 3*e* of the dielectric block 1 constitute five quarter-wavelength dielectric coaxial resonators, respectively. As best seen in FIG. 6, a pair of input and output electrodes 6 for capacitively coupling with the dielectric coaxial resonators of the inner conductors 4*a* and 4*e* and capacitance coupling electrodes 7 for capacitively coupling the dielectric coaxial resonators of the inner conductors 4*b* and 4*d* with each other through capacitances are disposed close to the first end surface 1*a* so as to be electrically insulated form the outer conductor 5 by cutting parts of the outer conductor 5 located on the bottom surface 1*d* of the dielectric block 1, respectively. It is to be noted that the electric field strength on the side of the first end surface 1*a* of the dielectric block 40, on which a pair of input and output electrodes 6 and the capacitance coupling electrodes 7 are formed, is stronger than that on the side of the second end surface 1*b* of the dielectric block 40.

In the conventional dielectric resonator apparatus as constructed above, since the coupling capacitances (referred to as internal coupling capacitances hereinafter) obtained respectively between the capacitance coupling electrodes 7 and the inner conductors 4*b* and 4*d* are smaller than input and output capacitances (referred to as external coupling capacitances hereinafter) obtained respectively by a pair of input and output electrodes 6 and the inner conductors 4*a* and 4*e*, it is necessary to set the size of each of the capacitance coupling electrodes 7 to be smaller than that of each of a pair of input and output electrodes 6. Therefore, it is extremely difficult to design the capacitance electrodes 7, and also the reliability of the capacitance coupling electrodes 7 becomes relatively lower.

The device base 2 of a dielectric substrate is made of a dielectric material having a relatively low dielectric constant such as alumina, glass, ceramics, resin, Vectra (registered trademark) or the like. On a top surface of the device base 2, an earth electrode 8, a pair of input and output electrodes 9 and a bypass electrode 10 are disposed so as to be electrically insulated from each other. The dielectric block 40 is fixedly mounted on the top surface of the device base 2 so that the bottom surface 1*d* of the dielectric block 40 is in contact with the top surface of the device base 2.

Then, a pair of input and output electrodes 6 formed on the bottom surface 1*d* of the dielectric block 40 is electrically connected to a pair of input and output electrodes 9 formed on the top surface of the device base 2, respectively, and also the capacitance coupling electrodes 7 formed on the bottom surface 1*d* of the dielectric block 40 are electrically connected to both ends of the bypass electrode 10, respectively. Further, the outer conductor 5 of the dielectric block 1 is electrically connected to the earth electrode 8 formed on the top surface of the device base 2. It is to be noted that resist films 11 are formed as shown by dotted lines of FIG. 6 at predetermined positions on the top surface of the device base 2, in order that a pair of input and output electrodes 9 and the bypass electrode 10 are electrically insulated from the outer conductor 5. Furthermore, the dielectric resonator apparatus 30 comprising the dielectric block 40 and the device base 2 is mounted on a surface of a printed circuit board (not shown).

When we try to respectively obtain an external coupling capacitance and an internal coupling capacitance larger than predetermined necessary capacitances in the above-mentioned conventional dielectric resonator apparatus, it is necessary to set the size of the capacitance coupling electrodes 7 to be smaller than that of a pair of input and output electrodes 6 because of the above-mentioned difference between both the necessary capacitances. Therefore, it is extremely difficult to design and form the above-mentioned capacitance coupling electrodes 7, and the reliability of the capacitance coupling electrodes 7 becomes relatively low.

SUMMARY OF THE INVENTION

One of the objects of the preferred embodiments of the present invention is therefore to provide a dielectric resonator apparatus which includes at least three quarter-wavelength dielectric coaxial resonators, capable of easily forming capacitance coupling electrodes for obtaining internal coupling capacitances.

Another object of the preferred embodiments of the present invention is to provide a dielectric resonator apparatus which includes at least three quarter-wavelength dielectric coaxial resonators, having a reliability higher than that of the conventional dielectric resonator apparatus.

One of the preferred embodiments of the present invention provides a dielectric resonator apparatus including a dielectric block of a dielectric material having first and second end surfaces, and a plurality of side surfaces located between the first end surface and the second end surface and at least three cylindrical resonator holes disposed in parallel to each other so as to penetrate an inner portion of the dielectric block. Each of the resonator holes has an opening on the first end surface of the dielectric block and another opening on the second end surface of the dielectric block. The apparatus also includes an outer conductor disposed on the first and second end surfaces and the plurality of side surfaces of the dielectric block and at least three inner conductors disposed on inner portions of the resonator holes, respectively, so that one end of the inner conductors located at the first end surface of the dielectric block are electrically insulated from the outer conductor. Each inner conductor preferably has a longitudinal length of a quarter of the guide-wavelength, thereby constituting at least three quarter-wavelength dielectric coaxial resonators. The apparatus further includes a pair of input and output electrodes capacitively coupled with the two dielectric coaxial resonators located at both ends, respectively. The pair of input and output electrodes are disposed close to the first end surface of the dielectric block on a predetermined side surface of the dielectric block so as to be electrically insulated from the outer conductor.

The apparatus also includes two capacitance coupling electrodes capacitively coupled with the two dielectric coaxial resonators, respectively, which are selected among at least three dielectric coaxial resonators and are spaced apart from each other so as to put another dielectric coaxial resonator therebetween. The two capacitance coupling electrodes are disposed on the predetermined side surface of the dielectric block so as to be electrically insulated from the outer conductor as so as to be spaced from the first end surface by a predetermined length.

The apparatus further includes a bypass connector for electrically connecting the two capacitance coupling electrodes with each other.

The above-mentioned dielectric resonator apparatus also includes a device base of dielectric material for mounting the dielectric block thereon. The device base preferably includes a pair of input and output further electrodes electrically connected to the pair of input and output electrodes. The pair of input and output further electrodes are disposed on the device base opposite to the pair of input and output electrodes when the dielectric block is mounted on the device base.

The device base also includes an earth electrode electrically connected to the outer conductor. The earth electrode is disposed on the device base opposite to the earth electrode when the dielectric block is mounted on the device base.

The bypass connector is preferably a bypass electrode disposed on the device base so that both ends of the bypass electrode oppose the two capacitance coupling electrodes, respectively, when the dielectric block is mounted on the device base.

In the above-mentioned dielectric resonator apparatus, the dielectric resonator apparatus preferably comprises five quarter-wavelength dielectric coaxial resonators. The two capacitance coupling electrodes are respectively capacitively coupled to the two dielectric coaxial resonators, which are other than the two dielectric coaxial resonators located at both ends and the dielectric coaxial resonator located in the center.

In the above-mentioned dielectric resonator apparatus, the dielectric resonator apparatus preferably comprises four quarter-wavelength dielectric coaxial resonators. The two capacitance coupling electrodes are respectively capacitively coupled to the two dielectric coaxial resonators, which are other than a predetermined one dielectric coaxial resonator located at one end and one dielectric coaxial resonator previously selected from the two dielectric coaxial resonators in the vicinity of the center.

In the above-mentioned dielectric resonator apparatus, the dielectric resonator apparatus preferably comprises three quarter-wavelength dielectric coaxial resonators. The two capacitance coupling electrodes are respectively capacitively coupled to the two dielectric coaxial resonators located at both ends.

According to the present preferred embodiment of the present invention, the outer conductor is disposed on the outer surfaces of the dielectric block in which the inner conductors are formed, and the two capacitance coupling electrodes for capacitively coupling the two dielectric coaxial resonators with each other through the internal coupling capacitances and a pair of input and output electrodes for capacitively coupling with the dielectric coaxial resonators located at both ends respectively through the external coupling capacitances are formed so as to be electrically insulated from the outer conductor, for example, by cutting parts of the outer conductor. In the dielectric resonator apparatus having such a structure, the capacitance coupling electrodes are arranged at locations where the electric field strength is weaker than that of the locations of a pair of input and output electrodes. In this case, the size or the area of each of the capacitance coupling electrodes can be increased. Therefore, the capacitance coupling electrodes can be easily designed and formed with a higher reliability. This results in the reliability of the dielectric resonator apparatus being higher than that of the conventional dielectric resonator apparatus 30 shown in FIGS. 5 and 6.

BRIEF DESCRIPTION OF THE DRAWINGS

These and other objects and features of the preferred embodiments of the present invention will become clear from the following description taken in conjunction with the preferred embodiments thereof with reference to the accompanying drawings throughout which like parts are designated by like reference numerals, and in which.

DETAILED DESCRIPTION OF PREFERRED EMBODIMENTS

The preferred embodiments according to the present invention will be described below with reference to the attached drawings.

FIRST PREFERRED EMBODIMENT

Figure 1:
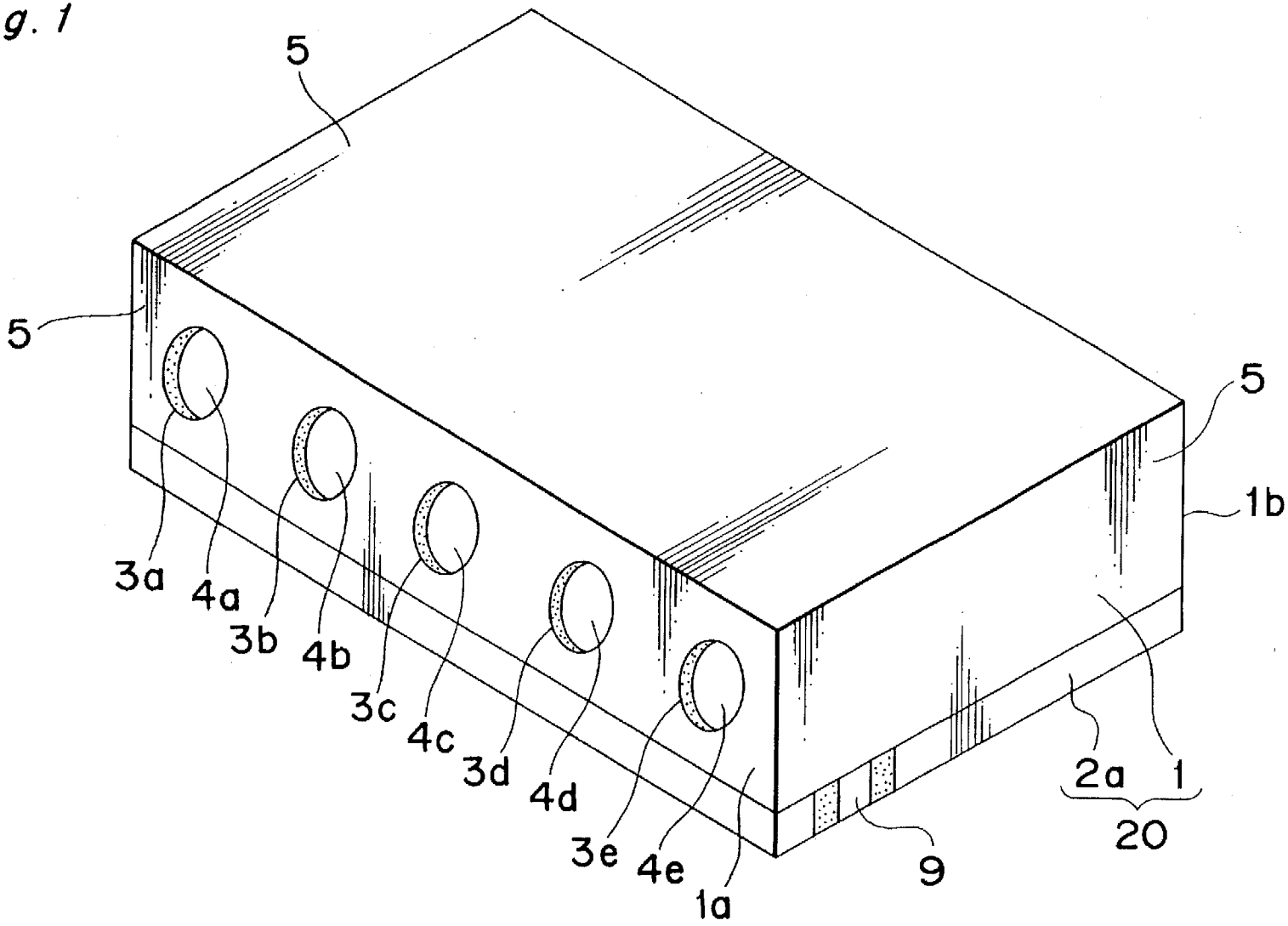
FIG. 1 is a perspective view of a dielectric resonator apparatus according to a first preferred embodiment of the present invention.
Figure 2:
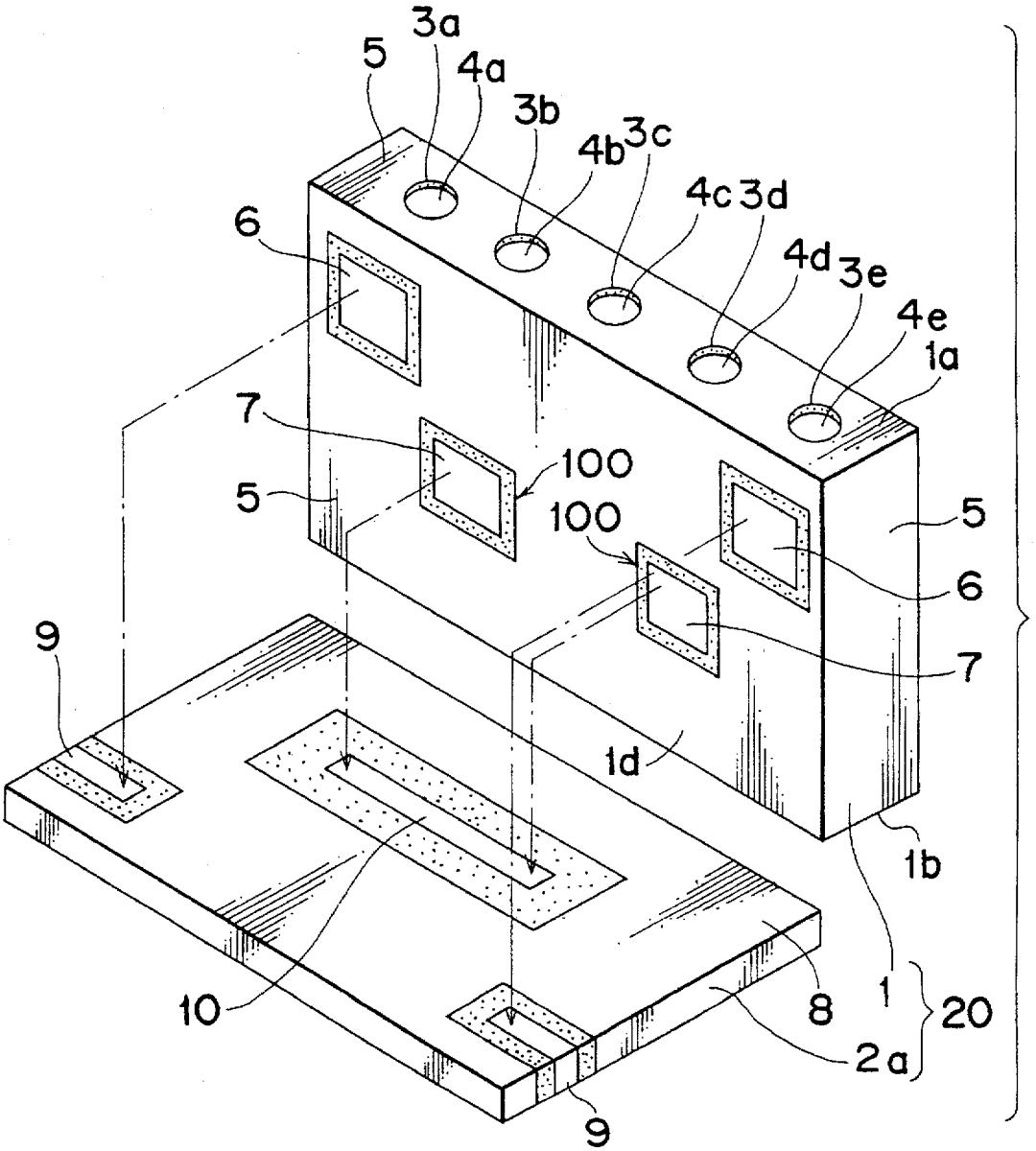
FIG. 2 is an exploded perspective view of the dielectric resonator apparatus shown in FIG. 1 prior to assembling the dielectric resonator apparatus.
Figure 5:
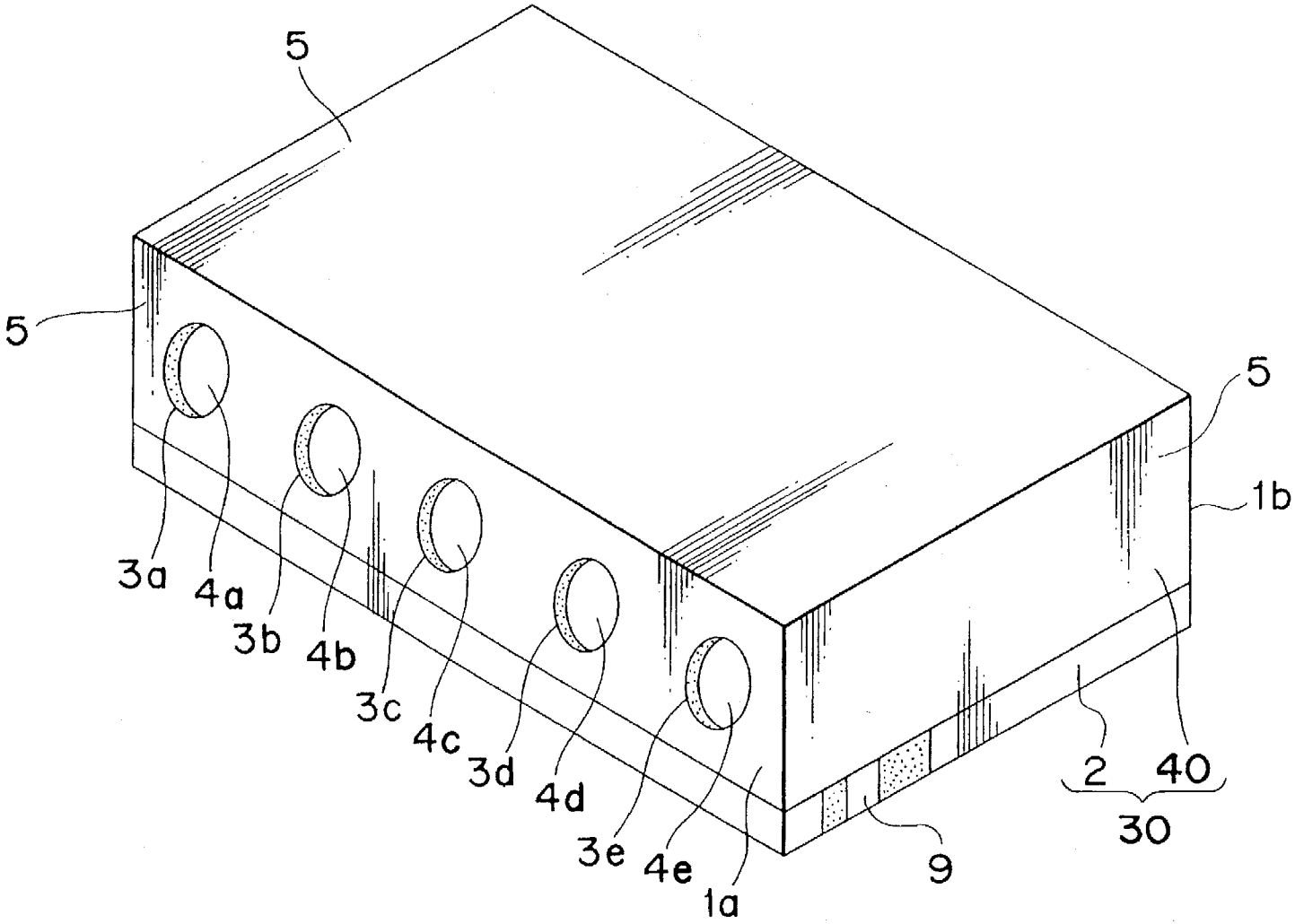
Fig. 5 PRIOR ART
FIG. 5 is a perspective view of a conventional dielectric resonator apparatus.
Figure 6:
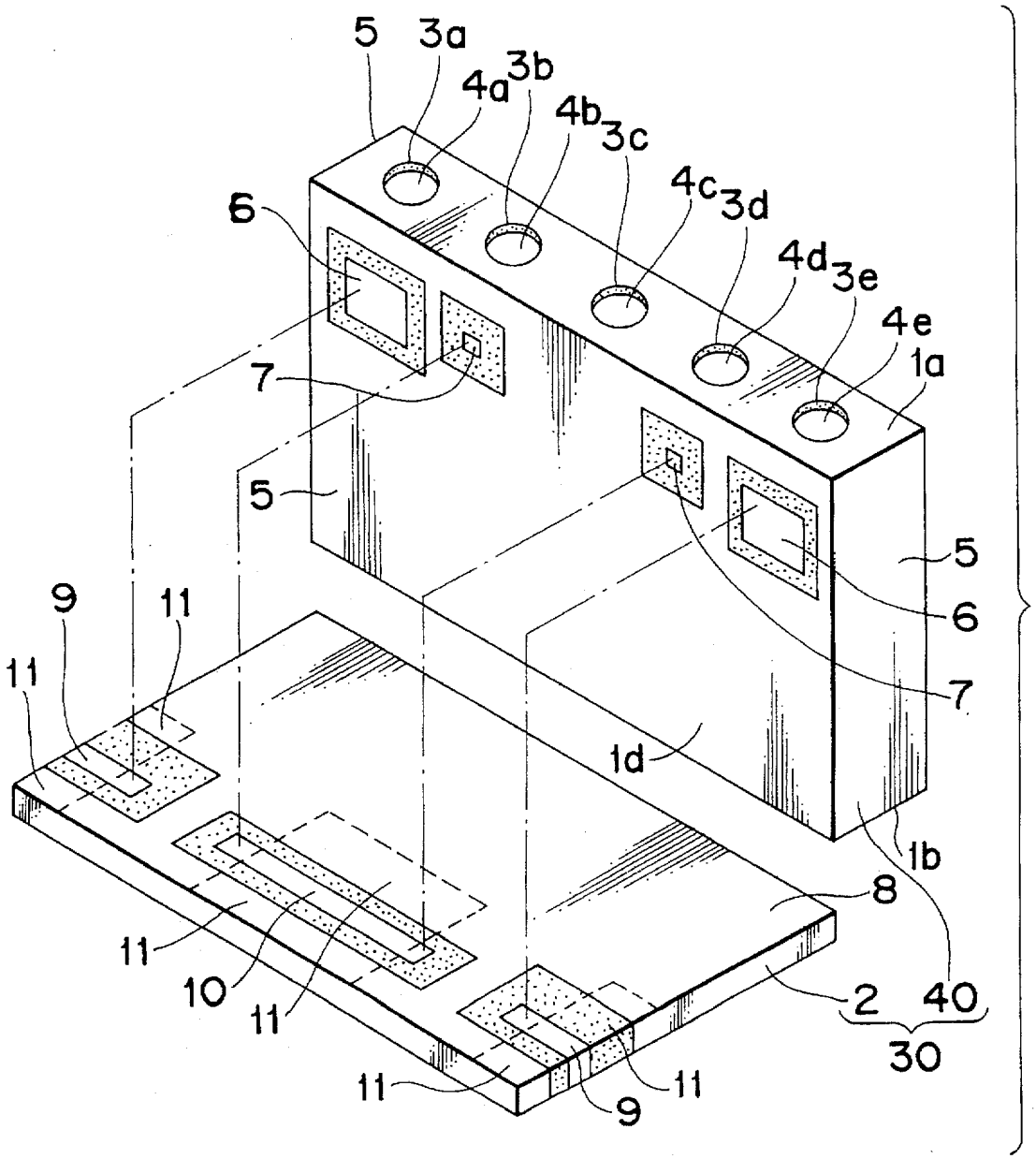
Fig. 6 PRIOR ART
FIG. 6 is an exploded perspective view of the conventional dielectric resonator apparatus shown in FIG. 5 prior to assembling the conventional dielectric resonator apparatus.

FIG. 1 is a perspective view of a dielectric resonator apparatus 20 according to a first preferred embodiment of the present invention and FIG. 2 is an exploded perspective view of the dielectric resonator apparatus 20 shown in FIG. 1 prior to assembling the dielectric resonator apparatus. In FIGS. 1 and 2, the same portions as those of the conventional apparatus shown in FIGS. 5 and 6 are denoted by the same numeral references.

Referring to FIGS. 1 and 2, the conventional dielectric resonator apparatus 20 is composed of a rectangular-parallelepiped-shaped dielectric block 1 and a device base 2*a* on which the dielectric block 1 is mounted. In the dielectric block 1, five circular cylindrical resonator holes 3*a*, 3*b*, 3*c*, 3*d* and 3*e* are formed in parallel to each other so as to penetrate the dielectric block 1 between first and second end surfaces 1*a* and 1*b* of the dielectric block 1, respectively, and then inner conductors 4*a*, 4*b*, 4*c*, 4*d* and 4*e* are formed on inner peripheral surfaces of the resonator holes 3*a*, 3*b*, 3*c*, 3*d* and 3*e*, respectively. Further, an outer conductor 5 is formed on all the outer surfaces of the dielectric block 1. Each of the inner conductors 4*a*, 4*b*, 4*c*, 4*d* and 4*e* each having the longitudinal length of a quarter of the guide-wavelength $\lambda g/4$, which are formed in the resonator holes 3*a*, 3*b*, 3*c*, 3*d* and 3*e*, has:

(a) an open-circuit end formed by cutting one end of each of the inner conductors 4*a*, 4*b*, 4*c*, 4*d* and 4*e* located on the side of the first end surface 1*a* of the dielectric block 1 so that each of the inner conductors 4*a*, 4*b*, 4*c*, 4*d* and 4*e* is electrically insulated from the outer conductor 5; and (b) another short-circuit end electrically connected to the outer conductor 5 located on the side of the second end surface 1*b* of the dielectric block 1.

Then the five inner conductors 4*a*, 4*b*, 4*c*, 4*d* and 4*e* respectively formed in the resonator holes 3*a*, 3*b*, 3*c*, 3*d* and 3*e* of the dielectric block 1 constitute five quarter-wavelength dielectric coaxial resonators, which are arranged so as to be parallel to each other in the dielectric block 1.

As best seen in FIG. 2, a pair of input and output electrodes 6 for capacitively coupling with the dielectric coaxial resonators of the inner conductors 4*a* and 4*e* through external coupling capacitances and capacitance coupling electrodes 7 for capacitively coupling the dielectric coaxial resonators of the inner conductors 4*b* and 4*d* with each other through inner coupling capacitances are formed so as to be electrically insulated from the outer conductor 5 by cutting parts of the outer conductor 5 formed on the bottom surface 1*d* of the dielectric block 1, respectively.

In the present preferred embodiment, as shown in FIG. 2, a pair of input and output electrodes 6 are formed respectively so as to be opposite to one end of the inner conductors 4*a* and 4*e* located in the side of the first end surface 1*a* and so as to be close to the first end surface 1*a* of the dielectric block 1. On the other hand, the capacitance coupling electrodes 7 are formed respectively at positions 100 slightly shifted from the conventional positions toward the side of the second end surface 1*b*, namely, in the vicinity of the center in the axial direction of the resonator holes 3*a*, 3*b*, 3*c*, 3*d* and 3*e*, so as to be opposite to in the vicinity of the center portions in the longitudinal direction of the inner conductors 4*b* and 4*d* and so as to be apart from the first end surface 1*a* of the dielectric block 1 by a predetermined length as compared with a pair of input and output electrodes 6, in order to arrange the capacitance coupling electrodes 7 in an electric field strength weaker than that of a pair of input and output electrodes 6.

The electric field strength at each position 100 at which the capacitance coupling electrodes 7 are formed is weaker than the electric field strength at each position at which a pair of input and output electrodes 6 are located since each of the inner conductors 4*a*, 4*b*, 4*c*, 4*d* and 4*e* has the open-circuit end located on the side of the first end surface 1*a* and another short-circuit located on the side of the second end surface 1*b*. Even though the area of each capacitance coupling electrode 7 is the same as that of each of a pair of input and output electrodes 6, the internal coupling capacitances respectively obtained between one capacitance coupling electrode 7 and the inner conductor 3*b* and between another capacitance coupling electrode 7 and the inner conductor 3*d* becomes smaller than the external coupling capacitances respectively obtained between the input electrode 6 and the inner conductor 3*a*. Therefore, by shifting the positions of the capacitance coupling electrodes 7 from the side of the first end surface 1*a* toward the side of the second end surface 1*b*, the internal coupling capacitance being smaller than the external coupling capacitance can be obtained under the condition that the area of each capacitance coupling electrode 7 is substantially the same as that of each of a pair of input and output electrodes 6.

The device base 2*a* of a dielectric substrate is of a dielectric material having a relatively low dielectric constant such as alumina, glass, ceramics, resin, Vectra (registered trademark) or the like. On a top surface of the device base 2*a*, an earth electrode 8, a pair of input and output electrodes 9 and a bypass electrode 10 are formed so as to be electrically insulated from each other and so as to oppose to the outer conductor 5, a pair of input and output electrodes 6 and the capacitance coupling electrodes 7 which are formed on the bottom surface 1*d* of the dielectric block 1 when they are assembled. Further, the dielectric block 1 is fixedly mounted on the top surface of the device base 2*a* so that the bottom surface 1*d* of the dielectric block 1 is in contact with the top surface of the device base 2*a*.

Then, a pair of input and output electrodes 6 formed on the bottom surface 1*d* of the dielectric block 1 is electrically connected to a pair of input and output electrodes 9 formed on the top surface of the device base 2*a*, respectively, and also the capacitance coupling electrodes 7 formed on the bottom surface 1*d* of the dielectric block 1 are electrically connected to both ends of the bypass electrode 10, respectively. Further, the outer conductor 5 of the dielectric block 1 is electrically connected to the earth electrode 8 formed on the top surface of the device base 2*a*.

Figure 3:
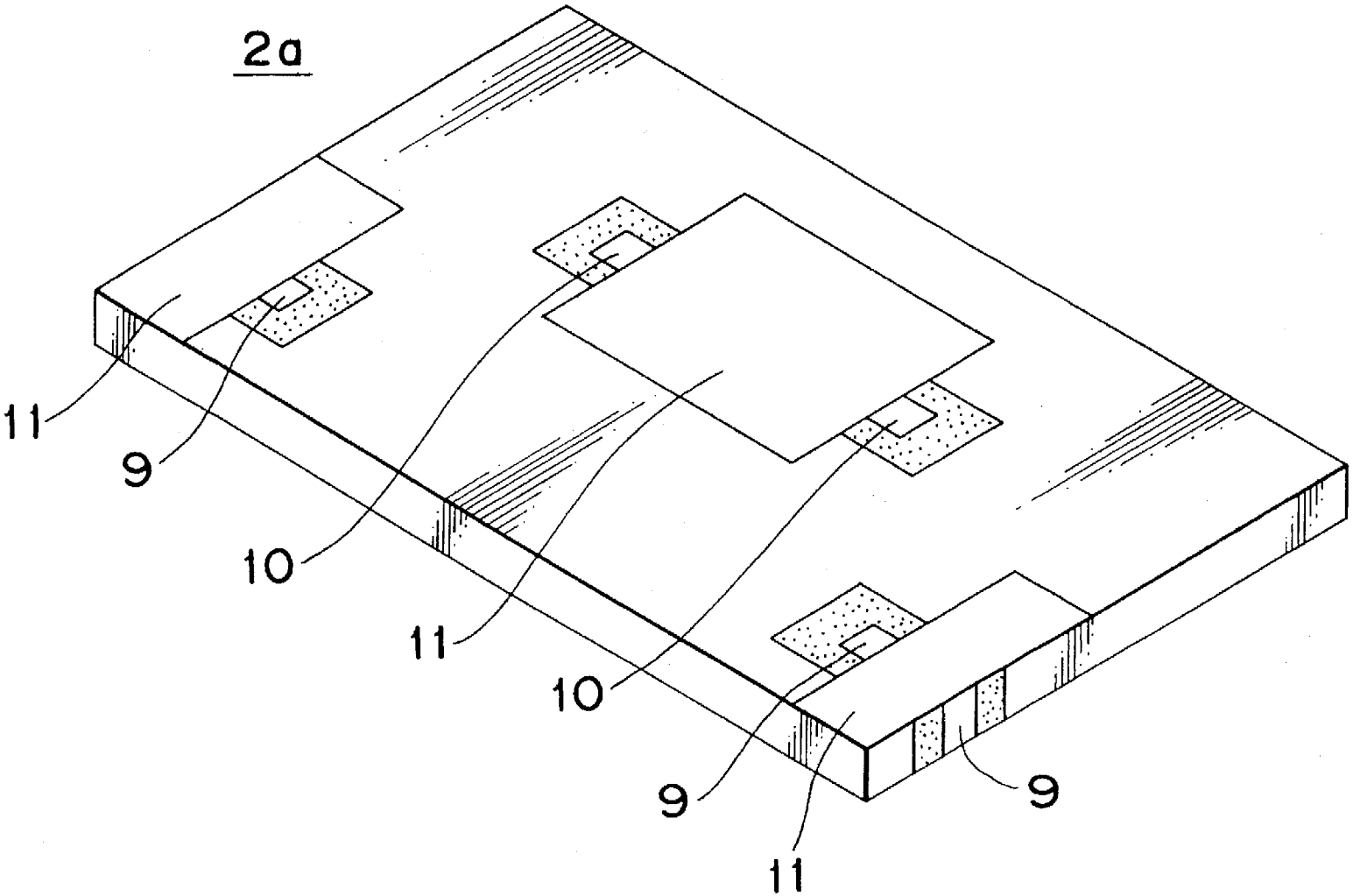
FIG. 3 is a perspective view of a device base of the dielectric resonator apparatus shown in FIG. 1.

FIG. 3 shows the device base 2*a* on which resist films 11 are formed. It is to be noted that the resist films 11 are not shown in FIG. 2.

Referring to FIG. 3, the resist films 11 are formed as shown at predetermined positions on the top surface of the device base 2*a*, in order that a pair of input and output electrodes 9 and the bypass electrode 10 are electrically insulated from the outer conductor 5 (see FIG. 2). Furthermore, the dielectric resonator apparatus 20 comprising the dielectric block 1 and the device base 2*a* is mounted on a surface of a printed circuit board (not shown).

Figure 4:
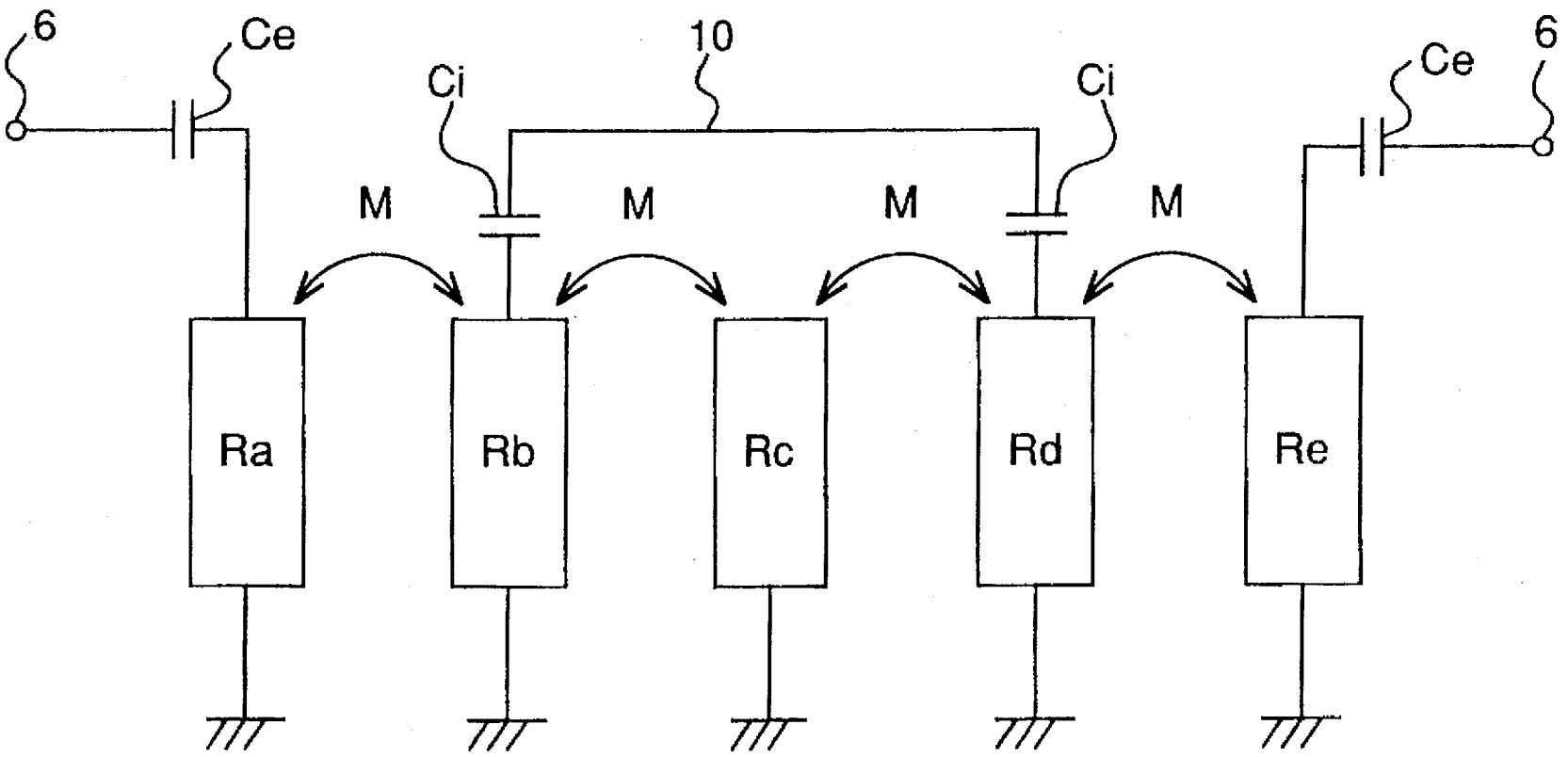
FIG. 4 is a circuit diagram of an equivalent circuit of the dielectric resonator apparatus shown in FIG. 1.

FIG. 4 is a circuit diagram of an equivalent circuit of the dielectric resonator apparatus 20 shown in FIG. 1. In FIG. 4, as well as in FIGS. 8 and 10 which will be described below, M represents the inductive coupling.

In FIGS. 4, Ra, Rb, Rc, Rd and Re denote the quarter-wavelength dielectric coaxial resonators corresponding to the inner conductors 4*a*, 4*b*, 4*c*, 4*d* and 4*e* formed in the resonator holes 3*a*, 3*b*, 3*c*, 3*d* and 3*e*, respectively. In the five dielectric coaxial resonators, the respective adjacent two dielectric coaxial resonators are inductively coupled with each other. Further, the dielectric coaxial resonator Ra is capacitively coupled with the input electrode 6 through the external coupling capacitance Ce, and the dielectric coaxial resonator Re is capacitively coupled with the output electrode 6 through the external coupling capacitance Ce.

Furthermore, the dielectric coaxial resonator Rb is capacitively coupled with one end of the bypass electrode 10 through the internal coupling capacitance Ci, and the dielectric coaxial resonator Rd is capacitively coupled with another end of the bypass electrode 10 through the internal coupling capacitance Ci. Therefore, the dielectric coaxial resonator Rb is capacitively coupled with the dielectric coaxial resonator Rd through the two internal coupling capacitances Ci. It is to be noted that the internal coupling capacitances Ci are called polar capacitances since the internal coupling capacitances Ci make a pole in the gain on frequency characteristic of a dielectric filter of the dielectric resonator apparatus.

The dielectric resonator apparatus having such a electric circuit composition shown in FIG. 4 operates as a dielectric band-pass filter having poles.

According to the present preferred embodiment of the present invention, the outer conductor 5 is formed on the outer surfaces of the dielectric block 1 in which the inner conductors 4*a*, 4*b*, 4*c*, 4*d* and 4*e* are formed, and the capacitance coupling electrodes 7 for capacitively coupling the dielectric coaxial resonators Rb and Rd with each other through the internal coupling capacitances Ci and a pair of input and output electrodes 6 for capacitively coupling with the dielectric coaxial resonators Ra and Re respectively through the external coupling capacitances Ce are formed so as to be electrically insulated from the outer conductor 5 by cutting parts of the outer conductor 5. In the dielectric resonator apparatus having such a structure, the capacitance coupling electrodes are arranged at the positions 100, the electric field strength of which is weaker than the electric field strength at the positions of a pair of input and output electrodes 6. In this case, the size or the area of each of the capacitance coupling electrodes 7 can be increased. Therefore, the capacitance coupling electrodes 7 can be easily designed and formed with a higher reliability. This results in the reliability of the dielectric resonator apparatus 20 becoming higher than that of the conventional dielectric resonator apparatus 30 shown in FIGS. 5 and 6.

SECOND PREFERRED EMBODIMENT

Figure 7:
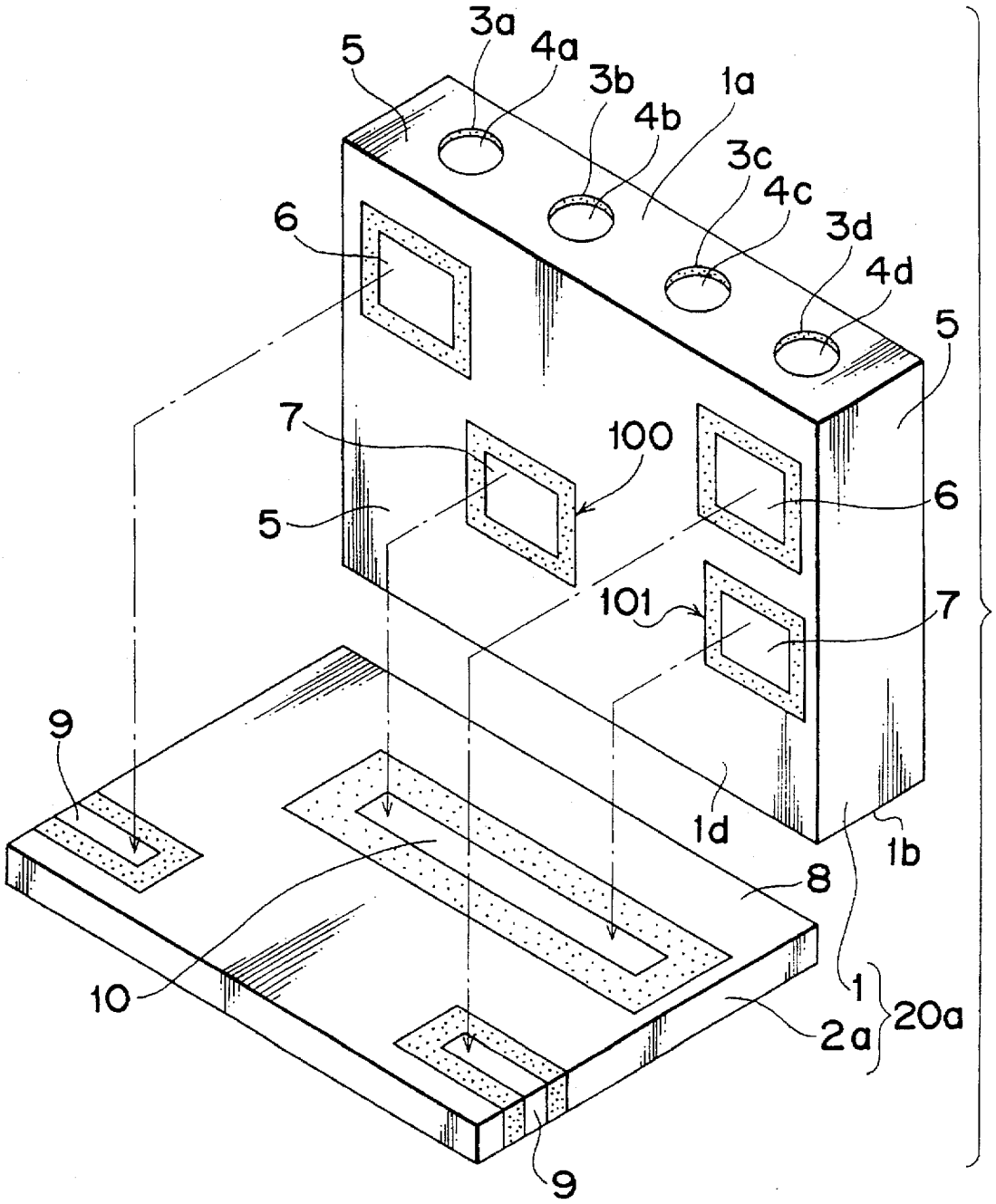
FIG. 7 is an exploded perspective view of a dielectric resonator apparatus according to a second preferred embodiment of the present invention.

FIG. 7 is an exploded perspective view of a dielectric resonator apparatus 20*a* according to a second preferred embodiment of the present invention. The differences between the first and second preferred embodiments are as follows.

Referring to FIG. 7, the dielectric resonator apparatus 20*a* comprises four dielectric coaxial resonators, and output electrode 7 is formed at a position 101 in the vicinity of the center in the axial direction of the dielectric coaxial resonator including the inner conductor 4*d* so as to be close to the inner conductor 4*d*. Further, the bypass electrode 10 is formed so that both ends thereof are opposite to the capacitance coupling electrodes 7, respectively, when the dielectric block I is mounted on the top surface of the device base 2*a*.

Figure 8:
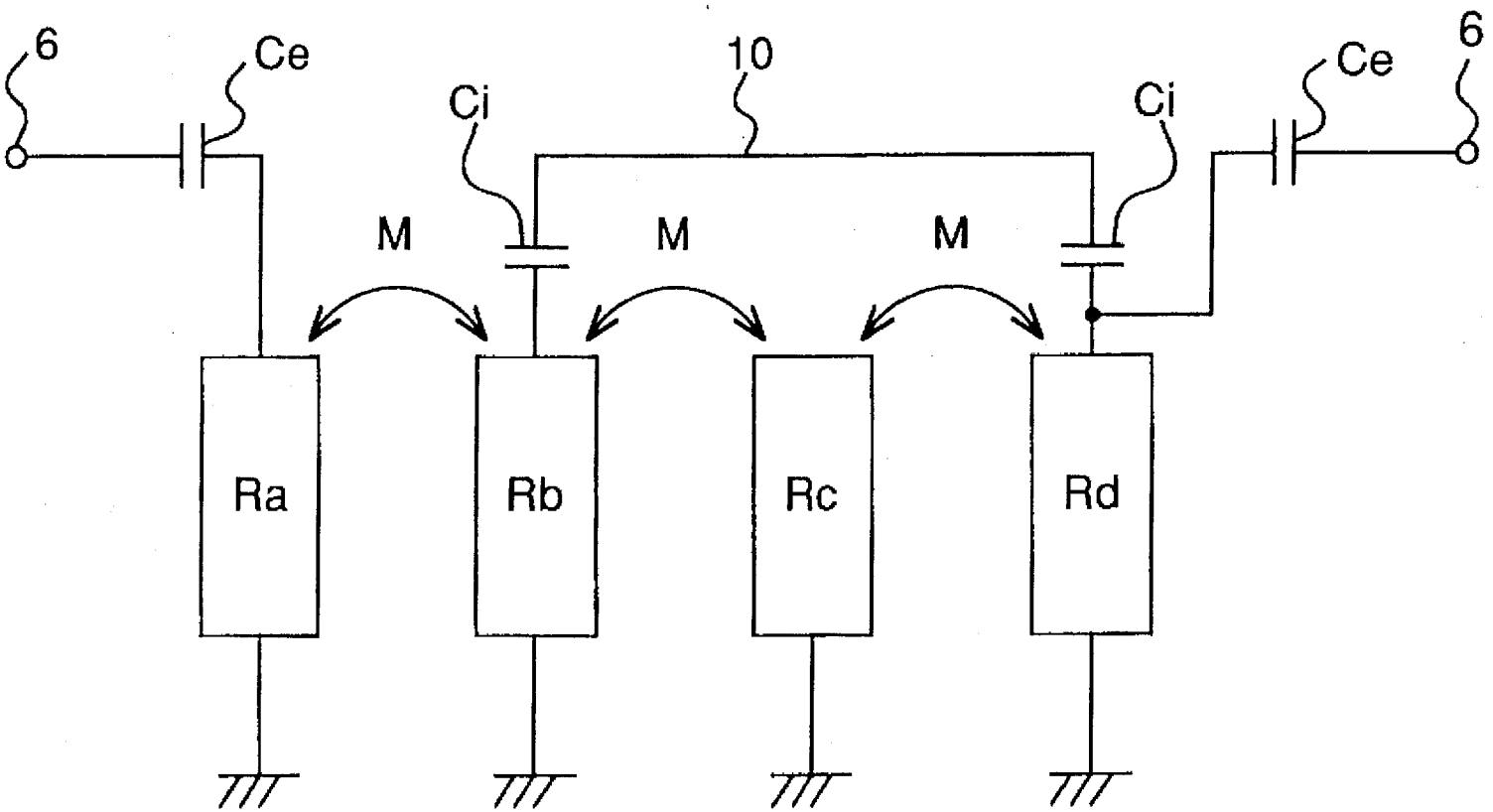
FIG. 8 is a circuit diagram of an equivalent circuit of the dielectric resonator apparatus shown in FIG. 7.

FIG. 8 is a circuit diagram of an equivalent circuit of the dielectric resonator apparatus shown in FIG. 7.

Referring to FIG. 8, there are provided four quarter-wavelength dielectric coaxial resonators Ra, Rb, Rc and Rd corresponding to the inner conductors 4*a*, 4*b*, 4*c* and 4*d* formed in the resonator holes 3*a*, 3*b*, 3*c* and 3*d*, respectively. In the four dielectric coaxial resonators, the respective adjacent two dielectric coaxial resonators are inductively coupled with each other. Further, the dielectric coaxial resonator Ra is capacitively coupled with the input electrode 6 through the external coupling capacitance Ce, and the dielectric coaxial resonator Rd is capacitively coupled with the output electrode 6 through the external coupling capacitance Ce.

Furthermore, the dielectric coaxial resonator Rb is capacitively coupled with one end of the bypass electrode 10 through the internal coupling capacitance Ci, and the dielectric coaxial resonator Rd is capacitively coupled with another end of the bypass electrode 10 through the internal coupling capacitance Ci. Therefore, the dielectric coaxial resonator Rb is capacitively coupled with the dielectric coaxial resonator Rd through the two internal coupling capacitances Ci. It is to be noted that the internal coupling capacitances Ci are called polar capacitances since the internal coupling capacitances Ci make a pole in the gain on frequency characteristic of a dielectric filter of the dielectric resonator apparatus.

The dielectric resonator apparatus having such a electric circuit composition shown in FIG. 7 operates as a dielectric band-pass filter having poles.

In the second preferred embodiment, the two capacitance coupling electrodes capacitively couple with two respective dielectric coaxial resonators, which are other than a predetermined one dielectric coaxial resonator located at one end and one dielectric coaxial resonator previously selected from the two dielectric coaxial resonators in the vicinity of the center.

THIRD PREFERRED EMBODIMENT

Figure 9:
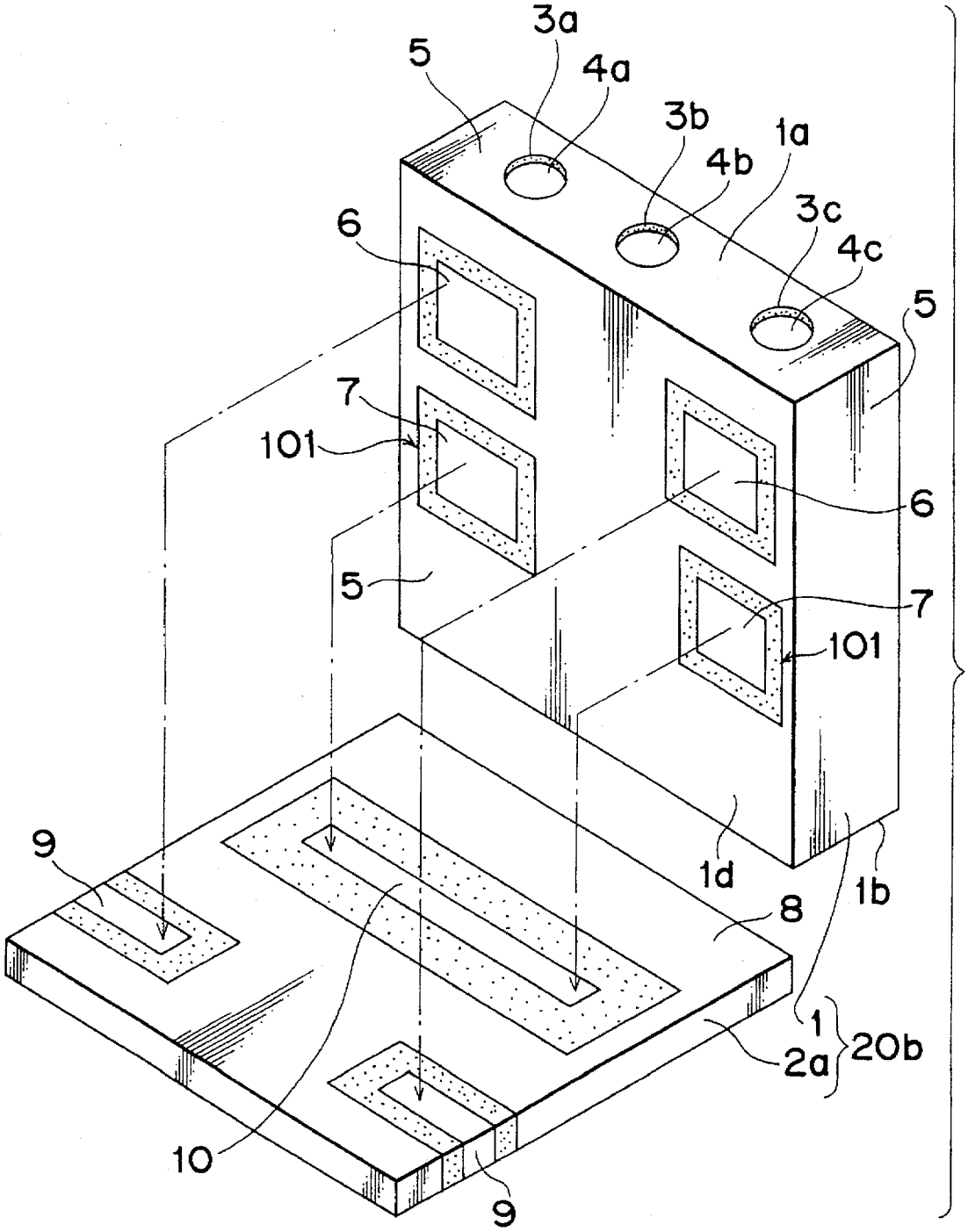
FIG. 9 is an exploded perspective view of a dielectric resonator apparatus according to a third preferred embodiment of the present invention.

FIG. 9 is an exploded perspective view of a dielectric resonator apparatus 20*b* according to a third preferred embodiment of the present invention. The differences between the first and third preferred embodiments are as follows.

Referring to FIG. 9, the dielectric resonator apparatus 20*b* comprises three dielectric coaxial resonators. A pair of input and output electrodes 7 is formed, respectively, at positions 101 in the vicinity of halfway along the axial length of the dielectric coaxial resonators and close to the inner conductors 4*a* and 4*c*, respectively. Further, the bypass electrode 10 is formed so that both ends thereof opposite to the capacitance coupling electrodes 7, respectively when the dielectric block 1 is mounted on the top surface of the device base 2*a*.

Figure 10:
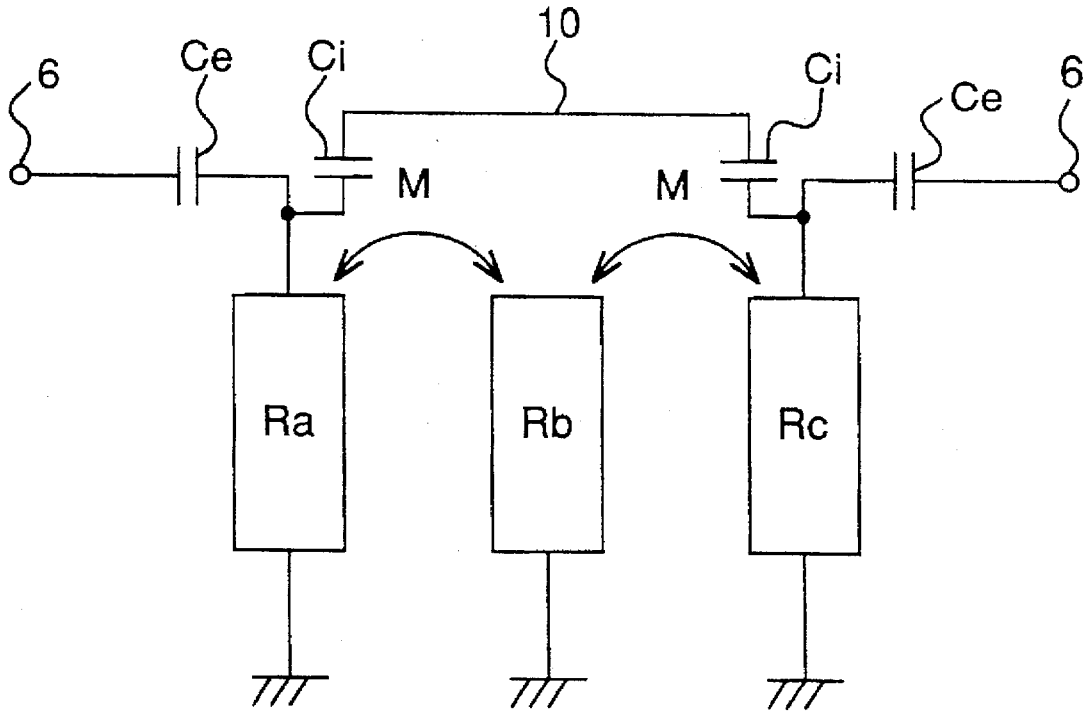
FIG. 10 is a circuit diagram of an equivalent circuit of the dielectric resonator apparatus shown in FIG. 9.

FIG. 10 is a circuit diagram of an equivalent circuit of the dielectric resonator apparatus 20*b* shown in FIG. 9.

Referring to FIG. 10, there are provided the three quarter-wavelength dielectric coaxial resonators Ra, Rb and Rc corresponding to the inner conductors 4a, 4b and 4c formed in the resonator holes 3a, 3b and 3c, respectively. In the three dielectric coaxial resonators, the respective adjacent two dielectric coaxial resonators are inductively coupled with each other. Further, the dielectric coaxial resonator Ra is capacitively coupled with the input electrode 6 through the external coupling capacitance Ce, and the dielectric coaxial resonator Rc is capacitively coupled with the output electrode 6 through the external coupling capacitance Ce.

Furthermore, the dielectric coaxial resonator Ra is capacitively coupled with one end of the bypass electrode 10 through the internal coupling capacitance Ci, and the dielectric coaxial resonator Rc is capacitively coupled with another end of the bypass electrode 10 through the internal coupling capacitance Ci. Therefore, the dielectric coaxial resonator Ra is capacitively coupled with the dielectric coaxial resonator Rc through the two internal coupling capacitances Ci. It is to be noted that the internal coupling capacitances Ci are called polar capacitances since the internal coupling capacitances Ci make a pole in the gain on frequency characteristic of a dielectric filter of the dielectric resonator apparatus.

The dielectric resonator apparatus having such a electric circuit composition shown in FIG. 9 operates as a dielectric band-pass filter having poles.

OTHER PREFERRED EMBODIMENTS

In the above-mentioned preferred embodiments, there are formed the five, four and three dielectric coaxial resonators, respectively, however, the present invention is not limited to this. The dielectric resonator apparatus may comprise at least three dielectric coaxial resonators. In this case, the two dielectric coaxial resonators located at both ends of at least three dielectric coaxial resonators are capacitively coupled with a pair of input and output electrodes through external coupling capacitances, respectively, and the two dielectric coaxial resonators, which are selected among at least three dielectric coaxial resonators and are located apart from each other so as to put another one dielectric coaxial resonator therebetween, are capacitively coupled with each other through internal coupling capacitances formed by the capacitances electrodes.

In the above-mentioned preferred embodiments, the circular cylindrical resonator holes 3a, 3b, 3c, 3d and 3e are formed in the dielectric block 1. However, the present invention is not limited to this arrangement. The cylindrical resonator holes having another shape such as a rectangular cylindrical shape, a shape of a hexagonal prism, or the like may be formed in the dielectric block 1.

In the above-mentioned preferred embodiments, the bypass electrode 10 is formed on the top surface of the device base 2a, however, the present invention is not limited to this. The bypass electrode 10 may be formed on the bottom surface of the dielectric block 1 so as to electrically connect the two capacitance coupling electrodes 7 to each other.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator apparatus comprising:

a dielectric block of a dielectric material having first and second end surfaces, and a plurality of side surfaces located between the first end surface and the second end surface;

at least three cylindrical resonator holes parallel to each other and penetrating an inner portion of said dielectric block, each of said resonator holes having a respective opening on the first end surface of said dielectric block and another respective opening on the second end surface of said dielectric block;

an outer conductor disposed on the first and second end surfaces and on said plurality of side surfaces of said dielectric block;

at least three inner conductors on inner portions of said resonator holes, respectively, with respective first ends of said corresponding inner conductors being located at the first end surface of said dielectric block and being electrically insulated from said outer conductor, and respective second ends of said corresponding inner conductors electrically connected to said outer conductor at said second end surface of said dielectric block, constituting at least three quarter-wavelength dielectric coaxial resonators;

a pair of input and output electrodes for capacitively coupling with two of said at least three dielectric coaxial resonators located at a pair of opposite sides, respectively, of said dielectric block, said pair of input and output electrodes being spaced away from the first end surface of said dielectric block by a first respective predetermined distance on a predetermined side surface of said dielectric block and respectively electrically insulated from said outer conductor;

two capacitance coupling electrodes for capacitively coupling with a pair of said dielectric coaxial resonators, respectively, which are among said at least three dielectric coaxial resonators and are located apart from each other with another dielectric coaxial resonator therebetween, said two capacitance coupling electrodes being on said predetermined side surface of said dielectric block and electrically insulated from said outer conductor, and spaced away from the first end surface by a second respective predetermined distance, which is greater than said first respective predetermined distance, in a lengthwise direction of said resonators, and at a position where an electric field strength due to said pair of dielectric coaxial resonators is weaker than an electric field strength associated with said input and output electrodes; wherein said two capacitance coupling electrodes are arranged on said predetermined side surface of said dielectric block such that the two capacitance electrodes can be electrically connected by a bypass conductor located on a device base on which the resonator apparatus is mounted.

2. The dielectric resonator apparatus claimed in claim 1, wherein said at least three quarter-wavelength dielectric coaxial resonators comprise five quarter-wavelength dielectric coaxial resonators, and wherein said two capacitance coupling electrodes respectively capacitively couple with two dielectric coaxial resonators, which are other than said two dielectric coaxial resonators located at said opposite sides, and are other than a dielectric coaxial resonator located at a center of said dielectric block.

3. The dielectric resonator apparatus claimed in claim 1, further comprising a device base of dielectric material for mounting said dielectric block thereon, wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and an earth electrode for electrically connecting to said outer conductor, said earth electrode being on said device base so as to oppose said outer conductor when said dielectric block is mounted on said device base;

wherein said bypass conductor is a bypass electrode on said device base, said bypass electrode having ends which oppose said two capacitance coupling electrodes, respectively, when said dielectric block is mounted on said device base.

4. The dielectric resonator apparatus claimed in claim 3, wherein said at least three quarter-wavelength dielectric coaxial resonators comprise five quarter-wavelength dielectric coaxial resonators, and wherein said two capacitance coupling electrodes respectively capacitively couple with two dielectric coaxial resonators, which are other than said two dielectric coaxial resonators located at said opposite sides, and other than a dielectric coaxial resonator located at a center of said dielectric block.

5. The dielectric resonator apparatus claimed in claim 1, wherein said capacitance coupling electrodes are in the vicinity of a center of said dielectric block and opposed to respective centers of said pair of dielectric resonators along the corresponding lengthwise direction thereof.

6. The dielectric resonator apparatus claimed in claim 1, wherein a respective internal coupling capacitance obtained between each capacitance coupling electrode and the corresponding inner conductor is less than an external coupling capacitance respectively realized between each input and output electrode and the corresponding inner conductor.

7. The dielectric resonator apparatus claimed in claim 6, wherein each one of the capacitance coupling electrodes has a surface area which is substantially the same as a surface area associated with each one of the input and output electrodes.

8. The dielectric resonator apparatus claimed in claim 1, wherein said at least three quarter-wavelength dielectric coaxial resonators comprise five quarter-wavelength dielectric coaxial resonators, and wherein said two capacitance coupling electrodes also respectively capacitively couple with said pair of dielectric coaxial resonators located at said opposite sides of said dielectric block.

9. The dielectric resonator apparatus claimed in claim 8, further comprising a device base of dielectric material for mounting said dielectric block thereon, wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and an earth electrode for electrically connecting to said outer conductor, said earth electrode being on said device base so as to oppose said outer conductor when said dielectric block is mounted on said device base;

wherein said bypass conductor is a bypass electrode on said device base, said bypass electrode having ends which oppose said two capacitance coupling electrodes, respectively, when said dielectric block is mounted on said device base.

10. A dielectric resonator apparatus comprising:

a dielectric block of a dielectric material having first and second end surfaces, and a plurality of side surfaces located between the first end surface and the second end surface;

at least three cylindrical resonator holes parallel to each other and penetrating an inner portion of said dielectric block, each of said resonator holes having a respective opening on the first end surface of said dielectric block and another respective opening on the second end surface of said dielectric block;

an outer conductor on the first and second and surfaces and on said plurality of side surfaces of said dielectric block;

at least three inner conductors on inner portions of said resonator holes, respectively, with respective first ends of said corresponding inner conductors being located at the first end surface of said dielectric block and being electrically insulated from said outer conductor, and respective second ends of said corresponding inner conductors electrically connected to said outer conductor at said second end surface of said dielectric block, each inner conductor having a respective longitudinal length of a quarter of the guide-wavelength, thereby constituting at least three quarter-wavelength dielectric coaxial resonators;

a pair of input and output electrodes for capacitively coupling with two of said at least three dielectric coaxial resonators located at a pair of opposite dies, respectively, of said dielectric block, said pair of input and output electrodes being close to the first end surface of said dielectric block on a predetermined side surface of said dielectric block so as to be respectively electrically insulated from said outer conductor;

two capacitance coupling electrodes for capacitively coupling with a pair of said dielectric coaxial resonators, respectively, which are among said at least three dielectric coaxial resonators and are located apart from each other with another dielectric coaxial resonator therebetween, said two capacitance coupling electrodes being disposed on said predetermined side surface of said dielectric block so as to be respectively electrically insulated from said outer conductor and so as to be spaced away from the first end surface by a respective predetermined distance; wherein said two capacitance coupling electrodes are arranged on said predetermined side surface of said dielectric block such that the two capacitance electrodes are electrically connected by a bypass conductor located on a device base to which the resonator apparatus is fixed;

said at least three quarter-wavelength dielectric coaxial resonators comprise five quarter-wavelength dielectric coaxial resonators, and wherein one of said pair of dielectric coaxial resonators being said dielectric coaxial resonator which is located at one of said opposite sides and the other of said pair of dielectric coaxial resonators which is in the vicinity of a center of said dielectric block.

11. A dielectric resonator apparatus comprising:

a dielectric block of a dielectric material having first and second end surfaces, and a plurality of side surfaces located between the first end surface and the second end surface;

at least three cylindrical resonator holes parallel to each other and penetrating an inner portion of said dielectric block, each of said resonator holes having a respective opening on the first end surface of said dielectric block and another respective opening on the second end surface of said dielectric block;

an outer conductor on the first and second end surfaces and on said plurality of side surfaces of said dielectric block;

at least three inner conductors on inner portions of said resonator holes, respectively, with respective first ends of said corresponding inner conductors being located at the first end surface of said dielectric block and being electrically insulated from said conductor, and respective second ends of said corresponding inner conductors electrically connected to said outer conductor at said second end surface of said dielectric block, each inner conductor having a respective longitudinal length of a quarter of the guide-wavelength, thereby constituting at least three quarter-wavelength dielectric coaxial resonators;

a pair of input and output electrodes for capacitively coupling with two of said at least three dielectric coaxial resonators located at a pair of opposite sides, respectively, of said dielectric block, said pair of input and output electrodes being close to the first end surface of said dielectric block on a predetermined side surface of said dielectric block so as to be respectively electrically insulated from said outer conductor;

two capacitance coupling electrodes for capacitively coupling with a pair of said dielectric coaxial resonators, respectively, which are among said at least three dielectric coaxial resonators and are located apart from each other with another dielectric coaxial resonator therebetween, said two capacitance coupling electrodes being disposed on said predetermined side surface of said dielectric block so as to be respectively electrically insulated from said outer conductor and so as to be spaced away from the first end surface by a respective predetermined distance;

said two capacitance coupling electrodes being arranged on said predetermined side surface of said dielectric block such that the two capacitance electrodes are electrically connected by a bypass conductor located on a device base to which the resonator apparatus in fixed; and wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and an earth electrode for electrically connecting to said outer conductor, said earth electrode being on said device base so as to oppose said outer conductor when said dielectric block is mounted on said device base;

wherein said bypass conductor is a bypass electrode on said device base and said bypass electrode having ends which oppose said two capacitance coupling electrodes, respectively, when said dielectric block is mounted on said device base;

wherein said at least three quarter-wavelength dielectric coaxial resonators comprise five quarter-wavelength dielectric coaxial resonators, and wherein one of said pair of dielectric coaxial resonators being said dielectric coaxial resonator which is located at one of said opposite sides and the other of said pair of dielectric coaxial resonators which is in the vicinity of a center of said dielectric block.

12. A dielectric resonator apparatus comprising:

a dielectric block of a dielectric material having first and second end surfaces, and a plurality of side surfaces located between the first end surface and the second end surface;

at least three cylindrical resonator holes parallel to each other and penetrating an inner portion of said dielectric block, each of said resonator holes having a respective opening on the first end surface of said dielectric block and another respective opening on the second end surface of said dielectric block;

an outer conductor on the first and second end surfaces and on said plurality of side surfaces of said dielectric block;

at least three inner conductors on inner portions of said resonator holes, respectively, with respective first ends of said corresponding inner conductors being located at the first end surface of said dielectric block and being electrically insulated from said outer conductor, and respective second ends of said corresponding inner conductors electrically connected to said outer conductor at said second end surface of said dielectric block, each inner conductor having a respective longitudinal length of a quarter of the guide-wavelength, thereby constituting at least three quarter-wavelength dielectric coaxial resonators;

a pair of input and output electrodes for capacitively coupling with two of said at least three dielectric coaxial resonators located at a pair of opposite sides, respectively, of said dielectric block, said pair of input and output electrodes being close to the first end surface of said dielectric block on a predetermined side surface of said dielectric block so as to be respectively electrically insulated from said outer conductor;

two capacitance coupling electrodes for capacitively coupling with a pair of said dielectric coaxial resonators, respectively, which are among said at least three dielectric coaxial resonators and are located apart from each other with another dielectric coaxial resonator therebetween, said two capacitance coupling electrodes being on said predetermined side surface of said dielectric block so as to be respectively electrically insulated from said outer conductor and so as to be spaced away from the first end surface by a respective predetermined distance;

said two capacitance coupling electrodes being arranged on said predetermined side surface of said dielectric block such that the two capacitance electrodes are electrically connected by a bypass conductor located on a device base to which the resonator apparatus is fixed;

wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and and earth electrode for electrically connecting to said outer conductor, said earth electrode being on said device base so as to oppose said outer conductor when said dielectric block is mounted on said device base;

wherein said bypass conductor is a bypass electrode on said device base and said bypass electrode having ends which oppose said two capacitance coupling electrodes, respectively, when said dielectric block us mounted on said device base;

wherein said at least three quarter-wavelength dielectric coaxial resonators comprise five quarter-wavelength dielectric coaxial resonators, and wherein said two capacitance coupling electrodes also respectively capacitively couple with said pair of dielectric coaxial resonators located at said opposite sides of said dielectric block.

13. A dielectric resonator apparatus comprising:

a dielectric block of a dielectric material having first and second end surfaces, and a plurality of side surfaces located between the first end surface and the second end surface;

five cylindrical resonator holes parallel to each other and penetrating an inner portion of said dielectric block, each of said resonator holes having a respective opening on the first end surface of said dielectric block and another respective opening on the second end surface of said dielectric block;

an outer conductor disposed on the first and second end surfaces and on said plurality of side surfaces of said dielectric block;

five inner conductors on inner portions of said resonator holes, respectively, with respective first ends of said corresponding inner conductors being located at the first end surface of said dielectric block and being electrically insulated from said outer conductor, and respective second ends of said corresponding inner conductors electrically connected to said outer conductor at said second end surface of said dielectric block, said inner conductors each having a respective longitudinal length so as to constitute five quarter-wavelength dielectric coaxial resonators;

an input electrode and an output electrode for respectively capacitively coupling with a first pair of said five dielectric coaxial resonators which are disposed respectively at a corresponding pair of opposite sides of said dielectric block;

two capacitance coupling electrodes for capacitively coupling respectively with a second pair of said dielectric coaxial resonators, respectively, which are among said five dielectric coaxial resonators and are located apart from each other with another dielectric coaxial resonator therebetween, one of said second pair of dielectric coaxial resonators being one of said first pair of dielectric coaxial resonators which is located at one of said pair of opposite sides and the other of said second pair of dielectric coaxial resonators being in the vicinity of a center of said dielectric block; wherein said two capacitance coupling electrodes are arranged on a predetermined one of said side surfaces of said dielectric block such that the two capacitance electrodes can be electrically connected by a bypass conductor located on a device base on which the resonator apparatus is mounted.

14. The dielectric resonator apparatus claimed in claim 13, wherein:

said input and output electrodes are located close to the first end surface of said dielectric block on said predetermined side surface of said dielectric block and electrically insulated from said outer conductor;

said two capacitance coupling electrodes are also on said predetermined side surface of said dielectric block and electrically insulated from said outer conductor and spaced away from the first end surface by a respective predetermined distance; and further comprising said device base for mounting said dielectric block thereon, wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and an earth electrode for electrically connecting to said outer conductor, said earth electrode being on said device base so as to oppose said outer conductor when said dielectric block is mounted on said device base; and wherein said bypass conductor is a bypass electrode on said device base, said bypass electrode having ends which oppose said two capacitance coupling electrodes, respectively, when said dielectric block is mounted on said device base.

15. A dielectric resonator apparatus comprising:

a dielectric block of a dielectric material having first and second end surfaces, and a plurality of side surfaces located between the first end surface and the second end surface;

five cylindrical resonator holes parallel to each other and penetrating an inner portion of said dielectric block, each of said resonator holes having a respective opening on the first end surface of said dielectric block and another respective opening on the second end surface of said dielectric block;

an outer conductor disposed on the first and second end surfaces and on said plurality of side surfaces of said dielectric block;

five inner conductors on inner portions of said resonator holes, respectively, with respective first ends of said corresponding inner conductors being located at the first end surface of said dielectric block and being electrically insulated from said outer conductor, and respective second ends of said corresponding inner conductors electrically connected to said outer conductor at said second end surface of said dielectric block, said inner conductors having a respective longitudinal length so as to constitute five quarter-wavelength dielectric coaxial resonators;

an input electrode and an output electrode for respectively capacitively coupling with a first pair of said five dielectric coaxial resonators;

said input and output electrodes are located at a pair of opposite sides, respectively, of said dielectric block, said pair of input and output electrodes being close to the first end surface of said dielectric block on a predetermined side surface of said dielectric block and electrically insulated from said outer conductor;

two capacitance coupling electrodes for capacitively coupling with a second pair of said five dielectric coaxial resonators, respectively, said second pair of dielectric coaxial resonators being located at said opposite sides of said dielectric block;

said two capacitance coupling electrodes are on said predetermined side surface of said dielectric block and electrically insulated from said outer conductor and spaced away from the first end surface by a respective predetermined distance;

said two capacitance coupling electrodes being arranged on said predetermined side surface of said dielectric block such that the two capacitance electrodes are respectively electrically connected by a bypass conductor located on a device base on which the resonator apparatus is mounted; and wherein said device base comprises:

a further pair of input and output electrodes for electrically connecting to said pair of input and output electrodes, respectively, said further pair of input and output electrodes being on said device base so as to be respectively opposed to said pair of input and output electrodes when said dielectric block is mounted on said device base; and an earth electrode for electrically connecting to said outer conductor, said earth electrode being on said device base so as to oppose said outer conductor when said dielectric block is mounted on said device base; and wherein said bypass conductor is a bypass electrode on said device base, said bypass electrode having ends which oppose said two capacitance coupling electrodes, respectively, when said dielectric block is mounted on said device base.

16. A dielectric resonator apparatus comprising:

a dielectric block of a dielectric material having first and second end surfaces, and side surfaces located between the first end surface and the second end surface;

at least one cylindrical resonator hole penetrating said dielectric block, said at least one resonator hole having a respective opening on the first end surface of said dielectric block and another respective opening on the second end surface of said dielectric block;

an outer conductor disposed on the first and second end surfaces and on said side surfaces of said dielectric block;

a respective inner conductor on a corresponding inner portion of said at least one resonator hole, a respective first end of said corresponding inner conductor being located at the first end surface of said dielectric block and respectively electrically insulated from said outer conductor, and a respective second end of said corresponding inner conductor electrically connected to said outer conductor at said second end surface of said dielectric block, constituting at least one quarter-wavelength dielectric coaxial resonator;

a pair of input and output electrodes for capacitively coupling with respective portions of said at least one said dielectric coaxial resonator, said input and output electrodes being located on said dielectric block, said pair of input and output electrodes being spaced away from the first end surface of said dielectric block by a respective first predetermined distance and respectively electrically insulated from said outer conductor;

two capacitance coupling electrodes for capacitively coupling with respective portions of said at least one dielectric coaxial resonator, said two capacitance coupling electrodes being respectively electrically insulated from said outer conductor, and spaced away from the first end surface by a respective second predetermined distance, which is greater than said respective first predetermined distance, in a direction along a lengthwise direction of said at least one resonator, and at a position where an electric field strength due to said at least one dielectric coaxial resonator is weaker than an electric field strength associated with said input and output electrodes.

17. The dielectric resonator apparatus claimed in claim 16, wherein said respective capacitance coupling electrodes are in a center region of said dielectric block and opposed to a center portion of said at least one dielectric resonator.

18. The dielectric resonator apparatus claimed in claim 16, wherein a respective internal coupling capacitance obtained between each capacitance coupling electrode and the corresponding inner conductor portion is less than an external coupling capacitance respectively realized between each input and output electrode and the corresponding inner conductor portion.

19. The dielectric resonator apparatus claimed in claim 18, wherein each one of the capacitance coupling electrodes has a surface area which is substantially the same as a surface area associated with each one of the input and output electrodes.

* * * * *